US005277580A

United States Patent [19]

Miskolczi, Jr.

[11] Patent Number: 5,277,580

[45] Date of Patent: Jan. 11, 1994

[54] WALL CONSTRUCTION SYSTEM FOR REFRACTORY FURNACES

[75] Inventor: John Miskolczi, Jr., Manvel, Tex.

[73] Assignee: Lea-Con, Inc., Houston, Tex.

[21] Appl. No.: 18,001

[22] Filed: Feb. 16, 1993

[51] Int. Cl.[5] ..... F27D 1/04

[52] U.S. Cl. ..... 432/249; 52/249; 52/483; 110/336; 432/251

[58] Field of Search ..... 432/238, 247-249, 251, 252, 110/336; 52/236.2, 245, 249, 573, 698, 483

[56] References Cited

U.S. PATENT DOCUMENTS

| | | | |
|---|---|---|---|
| 570,995 | 11/1896 | Horner . | |
| 728,578 | 5/1903 | Huxley | 110/336 |
| 814,949 | 3/1906 | Edgar | 110/336 |
| 915,195 | 3/1909 | Lemb . | |
| 1,106,725 | 8/1914 | MacCallum | 432/248 |
| 1,328,380 | 1/1920 | Laird | 110/336 |
| 1,492,685 | 5/1924 | Hale | 52/561 |
| 1,529,183 | 3/1925 | Howren | 52/607 |
| 1,565,537 | 12/1925 | Wells | 52/567 |
| 1,569,197 | 1/1926 | MacCallum | 432/248 |
| 1,699,554 | 1/1929 | Wigglesworth | 52/564 |
| 1,946,083 | 2/1934 | Lambie | 432/248 |
| 1,978,077 | 10/1934 | Doyle et al. | 110/336 |
| 1,984,393 | 12/1934 | Brown | 52/561 |
| 2,029,492 | 2/1936 | Lindner | 432/248 |
| 2,042,560 | 6/1936 | Stewart | 432/248 |
| 2,142,404 | 1/1939 | Mueller | 52/567 |
| 2,263,848 | 11/1941 | Keaney | 432/248 |
| 2,288,372 | 6/1942 | Rump | 432/118 |
| 2,847,849 | 8/1958 | Reintjes | 52/479 |
| 2,903,876 | 9/1959 | Nannini | 432/252 |
| 3,269,070 | 8/1966 | Stoy | D25/113 |
| 3,315,950 | 4/1967 | Potocnik et al. | 110/336 |
| 3,328,014 | 6/1967 | Longenecker | 432/238 |
| 3,330,546 | 7/1967 | Bryan . | |
| 3,362,698 | 1/1968 | Cerny et al. . | |
| 3,431,693 | 3/1969 | Stephens | 110/336 |
| 3,633,890 | 1/1972 | Kozmin | 432/248 |
| 3,812,798 | 5/1974 | Merkle, Jr. | 432/238 |
| 3,869,247 | 3/1975 | Duessner | 432/80 |
| 4,015,929 | 4/1977 | Kamstrup-Larsen | 432/3 |
| 4,083,752 | 4/1978 | Bielski et al. | 110/336 |
| 4,122,642 | 10/1978 | Buchy | 110/336 |
| 4,151,693 | 5/1979 | Harvey | 52/405 |
| 4,291,514 | 9/1981 | Harvey | 52/509 |
| 4,340,360 | 7/1982 | Hoedl et al. | 432/119 |
| 4,389,189 | 6/1983 | Harvey et al. | 432/247 |
| 4,505,210 | 3/1985 | Schuck et al. | 110/336 |
| 4,508,504 | 4/1985 | Eschmann et al. | 432/248 |
| 4,529,178 | 7/1985 | Hosbein et al. | 266/283 |
| 4,569,659 | 2/1986 | Olsen et al. | 432/119 |
| 4,651,485 | 3/1987 | Osborne | 522/284 |
| 4,668,183 | 5/1987 | Patterson | 432/80 |
| 4,671,191 | 6/1987 | Schwalb | 110/336 |
| 4,697,531 | 10/1987 | Benedick | 110/336 |
| 4,977,838 | 12/1990 | Farrell et al. | 110/173 R |
| 5,060,428 | 10/1991 | Arthur, Jr. et al. | 52/561 |
| 5,117,604 | 6/1992 | Bly et al. | 522/509 |

FOREIGN PATENT DOCUMENTS

| | | |
|---|---|---|
| 604659 | 10/1934 | Fed. Rep. of Germany . |
| 3443933 | 5/1986 | Fed. Rep. of Germany . |
| 9381 | of 1904 | United Kingdom . |
| 882745 | 3/1960 | United Kingdom . |

*Primary Examiner*—William E. Tapolcai
*Attorney, Agent, or Firm*—Arnold, White & Durkee

[57] ABSTRACT

An improved wall construction system for refractory furnaces is disclosed. The system includes an outer support structure into which are incorporated a plurality of connecting pin receiving sleeves or apertures. The system further includes a plurality of regularly-shaped bricks which have engaging members and receiving cavities on the ends of the bricks and on the upper and lower surfaces of the bricks. The engaging members and receiving cavities are adapted to interlock the bricks relatively to each other to preclude lateral movement. The system further includes a plurality of anchoring members which are adapted to be received between an engaging member and a receiving cavity of adjacent bricks. The anchoring members further extend out from the bricks and include a connecting pin shaped and sized to engage within the apertures in this first support structure in order to anchor the brick wall system to the outer support system in use.

5 Claims, 5 Drawing Sheets

WALL CONSTRUCTION SYSTEM FOR REFRACTORY FURNACES

BACKGROUND OF THE INVENTION

The invention relates to wall construction systems for refractory furnaces and kilns and more specifically, it relates to an improved wall construction system for the inner refractory brick walls of such refractory furnaces and kilns.

Past experience has shown that some of the processes for which the kilns and/or furnaces of the present invention are used are sometimes subject to explosions within the structure that can displace the bricks used to build the inner lining of the structure. The replacement of such bricks is an expensive, time consuming process that can cause considerable downtime and result in substantial monetary loss.

It is therefore desirable to provide a wall construction configuration that secures a given furnace block to adjacent furnace blocks such that the force of an explosion is unlikely to cause relative movement of any of the blocks. At the same time, however, it is necessary to interconnect the blocks in a manner that allows the construction of furnaces thirty to sixty feet high, without loss of strength vertically. It is therefore important to also anchor or support the blocks so that the walls cannot cave inwardly or outwardly in reaction to an explosion or to other forces encountered in the process.

Presently known wall systems utilize complex anchoring systems, irregularly shaped bricks, and other features that are believed to make them disadvantageous and expensive to use. It is therefore desirable to also provide a simple brick configuration that may be easily anchored to a supporting structure in a manner that yields flexibility in terms of construction for differing sizes of structure (wherein the identical brick system may be used for a wide range of sizes and shapes), and that addresses needs such as room for expansion within the structure during the process due to heat and other factors. The construction of the bricks must still further provide the desired stability, heat, and erosion resistant properties commonly required for such structures.

SUMMARY OF THE INVENTION

The present invention meets the needs and overcomes the disadvantages discussed above by providing an improved wall construction system for refractory furnaces which comprises an interlocking brick structure including an anchoring system which provides flexibility as to the positioning of the anchoring members. This systems utilizes a limited number of configurations of refractory brick, wherein each different configuration has a uniform size and shape, thereby providing simplicity in construction and design regardless of the size of the furnace or, to a large degree, the shape of the furnace.

More particularly, the present invention provides an improved wall construction system for refractory furnaces including an outer support structure comprising, in the preferred embodiment, a plurality of vertical support members and a plurality of horizontal support members connected to the vertical support members. A plurality of L-shaped or V-shaped or tubular sleeve-forming members are attached transverse to the horizontal support members such that the sleeve forming members provide a plurality of vertically disposed apertures on the horizontal support members. The wall system further includes a plurality of "primary" bricks wherein the primary bricks each have a first surface, a second surface substantially parallel to the first surface, a first end and a second end. Each first surface of a primary brick includes a first engaging member extending from the first end to the second end. Each second surface of a primary brick has a first receiving cavity extending from the first end to the second end. The first engaging member of a primary brick and the first receiving cavity of a primary brick are complimentarily shaped and positioned such that the first engaging member on a first primary brick will engage the first receiving cavity of a second primary brick (stacked on top of the first brick) to restrain lateral movement of such a second primary brick relative to the first primary brick. Each primary brick further includes a first end having a second engaging member and a second end having a second receiving cavity. The second engaging member and the second receiving cavity are shaped and positioned to be complimentary with each other such that when the first primary brick is positioned with its first end adjacent the second end of the second primary brick, the second engaging member of such a first primary brick will engage in the second receiving cavity of such a second primary brick to restrain lateral movement of such a second primary brick relative to such a first primary brick. Moreover, the positioning and shaping of the first and second engaging members and the first and second receiving cavities is coordinated such that when the first end of a first primary brick is placed adjacent the second end of a second primary brick, the second engaging member of such a first primary brick is aligned with the second receiving cavity of such a second primary brick and the first engaging member of such a first primary brick aligns with the first engaging member of such a second primary brick. In this manner, the first engaging members of consecutive primary bricks form a continuous line across upper or lower surfaces of the primary bricks (depending on the orientation of the primary brick).

The wall construction system further includes a plurality of anchoring members which, in the preferred embodiment, are selectively spaced throughout the wall system. Each anchoring member comprises an attachment section, an extension section and connecting pin. The attachment section is shaped and sized to be complimentary with the first engaging members and first receiving cavities of the primary bricks such that the attachment section fits over the first engaging member and within the first receiving cavity at any point along the engaging members in use. The extension section is secured to the attachment section and is adapted to extend between the first surface of one primary brick and the second surface of another primary brick when two primary bricks are stacked on top of each other. The extension member is sized such that it extends a selected distance out from the sides of the primary bricks in use. The connecting pin member of the anchoring member, in turn, is attached to the extension section, and is positioned and sized such that the pin member will movably fit in an aperture of a horizontal support of the outer support structure when the primary bricks are installed in use.

In a preferred embodiment of the wall construction system of the present invention, the primary bricks each comprise a pair of parallel engagement members on the first surface and a pair of parallel receiving cavities on the second surface. The position and shaping of the parallel engagement members are coordinated such that when primary bricks are aligned end to end, the pair of parallel engaging members will align to form two continuous lines for attachment of an anchoring member in use.

In a more preferred embodiment of the present invention, the wall construction system will include corner bricks having engagement members and receiving cavities adapted to align with and interconnect with the engagement members and receiving cavities of the primary bricks.

In a still more preferred embodiment of the present invention, the improved wall construction system will include shelf means connected to the outer structure for supporting and dividing sections of brick in order to accommodate vertical expansion of the bricks.

Accordingly, the present invention provides an improved wall construction system for refractory furnaces which overcomes the previously discussed problems through means of an interlocking brick system which includes an anchoring system adapted to provide flexibility in attachment of the anchors to the bricks. The interconnection of the bricks with each other provides the stability and resistance to explosions necessary for the anticipated applications. The flexibility of the anchoring system provides flexibility in constructing and anchoring the wall system to a variety of sizes of outer support structures.

These and other advantages will be further explained by the following description.

BRIEF DESCRIPTION OF THE DRAWINGS

This invention will further be illustrated by reference to the appended drawings which illustrate particular embodiments of the wall construction system of the present invention.

DETAILED DESCRIPTION OF THE PREFERRED EMBODIMENTS

It will be understood that the present invention can be implemented in a number of different ways, all within the scope of the claims appended hereto. A presently preferred embodiment of the invention will now be described.

Figure 10:
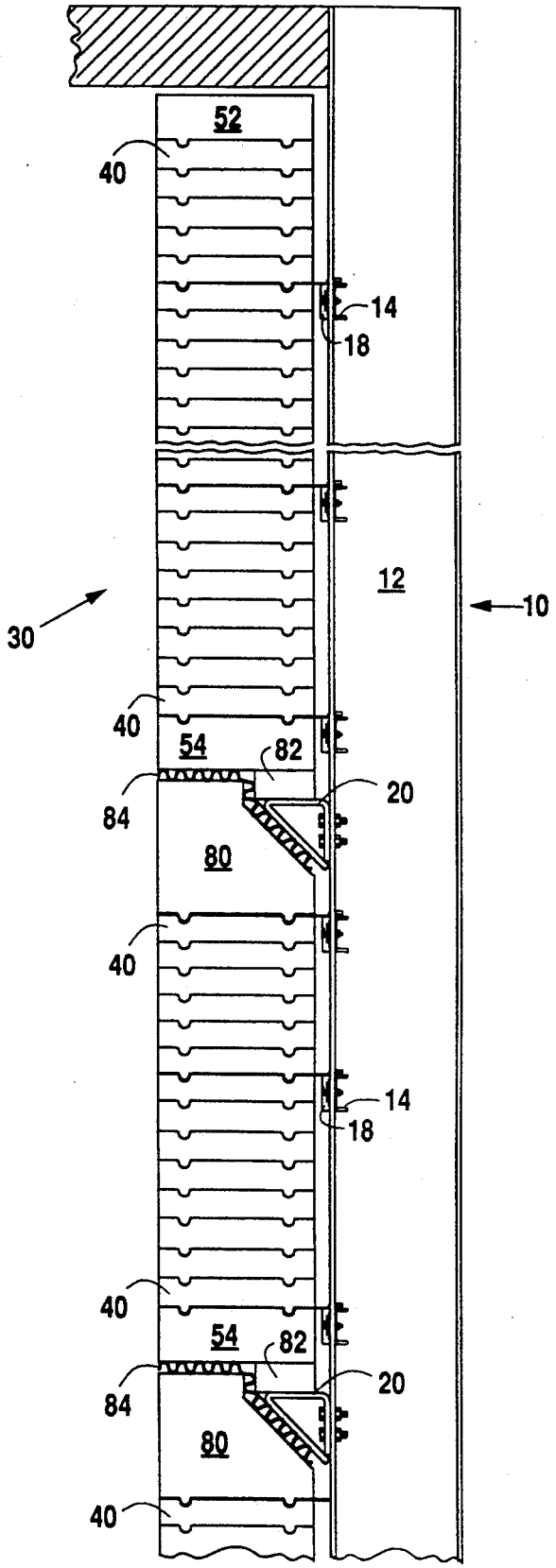
FIG. 10 is a side sectional view illustrating a wall constructed using the wall construction system of the present invention.
Figure 11:
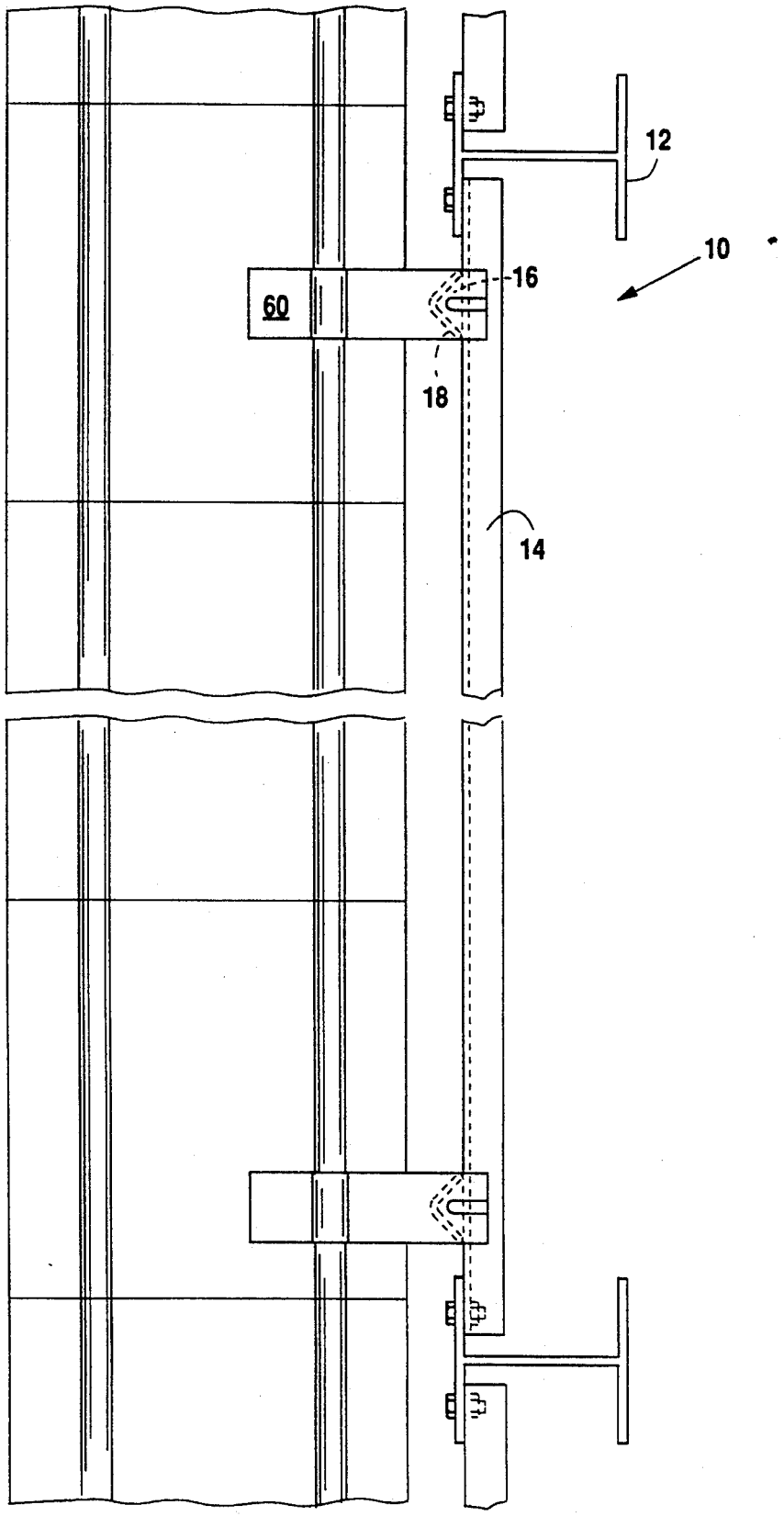
FIG. 11 is a top cut away view showing the positioning of the anchoring members relative to the engagement members and the horizontal support in accordance with the present invention.

Referring first to FIGS. 10 and 11, the present invention includes an outer support structure 10 which is adapted to support an inner wall structure of refractory bricks 30 in accordance with the present invention. The outer support structure may be comprised of a solid shell or of a variety of structural support members comprising materials adapted to withstand the heat generally encountered in furnaces and kilns. In the preferred embodiment, the outer support structure 10 includes a plurality of vertical support members 12 which are selected to provide sufficient vertical support to withstand the anticipated pressure and explosions from within the furnace and to restrain lateral movement of the inner wall construction 30. In the preferred embodiment, the vertical supports 12 are comprised of I-beams as shown in FIGS. 10 and 11.

Referring still to FIGS. 10 and 11, the outer support structure 10 may further include a plurality of horizontal support members 14 interconnected between the vertical support members 12. The horizontal support members 14 may be connected to the vertical support members 12 in a variety of configurations to provide the desired stability and reinforcement as will be apparent to those of skill in the art in view of the present disclosure. In this regard, the "horizontal" support members 14 need not be oriented horizontally in use. Rather, the horizontal support members 14 may be angled to provide truss-type reinforcement, if desired. As will become apparent from the subsequent description of the present invention, however, it is believed that horizontal orientation of the horizontal support members 14 provides the greatest simplicity of construction in view of the design and function of the anchoring members 60 discussed below.

The horizontal support members 14 may be comprised of a number of suitable materials having the necessary strength and heat resistance to withstand the conditions confronted in a kiln or furnace of the present invention, as will be appreciated by those of skill in the art in view of the present disclosure. The horizontal support members 14 may also be comprised of a variety of configurations such as angle iron, channel iron, etc. As shown in FIGS. 10 and 11, in the preferred embodiment, the horizontal support members 14 are comprised of channel iron connected between the vertical support members 12. In this regard, it should also be appreciated that the horizontal support members 14 may be connected to the vertical support members 12 in a variety of ways. In the preferred embodiment, the horizontal support members 14 are bolted to the vertical support members 12 as shown in FIG. 11. The horizontal support members 14 may also be attached to the vertical support members 12 by welding or other suitable means given the conditions encountered in the particular kiln or furnace.

The horizontal support members 14 further have a plurality of vertically disposed apertures adapted to receive the connecting pin 68 of the anchoring member 60 in use. Because of the extreme heat encountered in refractory furnaces and kilns, the refractory brick is subject to substantial expansion. It is therefore necessary to make the connection between the refractory brick walls 30 and the outer support structure 10, a connection which accounts for vertical expansion (since the height of a furnace causes vertical expansion to be the greatest component of expansion). Hence, the connection between the outer support system 10 and the inner wall construction 30 generally cannot be a rigid connection (if the rate of expansion of the inner wall construction 30 differs from the rate of expansion of the outer support structure 10). The present invention meets this need by providing a connection between the inner wall construction 30 and the outer support structure 10 which allows relative vertical movement. This relative vertical movement is accommodated by movably securing the connecting pin 68 of the anchoring member 60 within vertically oriented apertures in the outer support structure 10, which in the preferred embodiment are associated with the horizontal support members 14 of the outer support structure 10.

The apertures 16 on the outer support structure 10 may be created or formed in a variety of ways, so long as a suitable number of apertures 16 (sleeves or holes for receiving the connecting pin 69) are provided to accommodate connection points between the inner wall construction 30 and the outer support structure 10 sufficient to provide the desired stability in use. In the preferred embodiment, the apertures 16 are created by attaching an angle iron 18 to the horizontal support member 14 such that the angle iron 18 forms a vertically oriented sleeve as shown in FIGS. 10 and 11. It will be appreciated from the present disclosure, however, that a variety of sleeve-type members could be attached to the vertical support members 12 or the horizontal support members 14 to provide an aperture 16 with the desired orientation. Moreover, it may also be possible to drill holes directly into the horizontal support members 14 to provide the desired vertically disposed apertures for receiving the anchoring members 60 in use.

Figure 12:
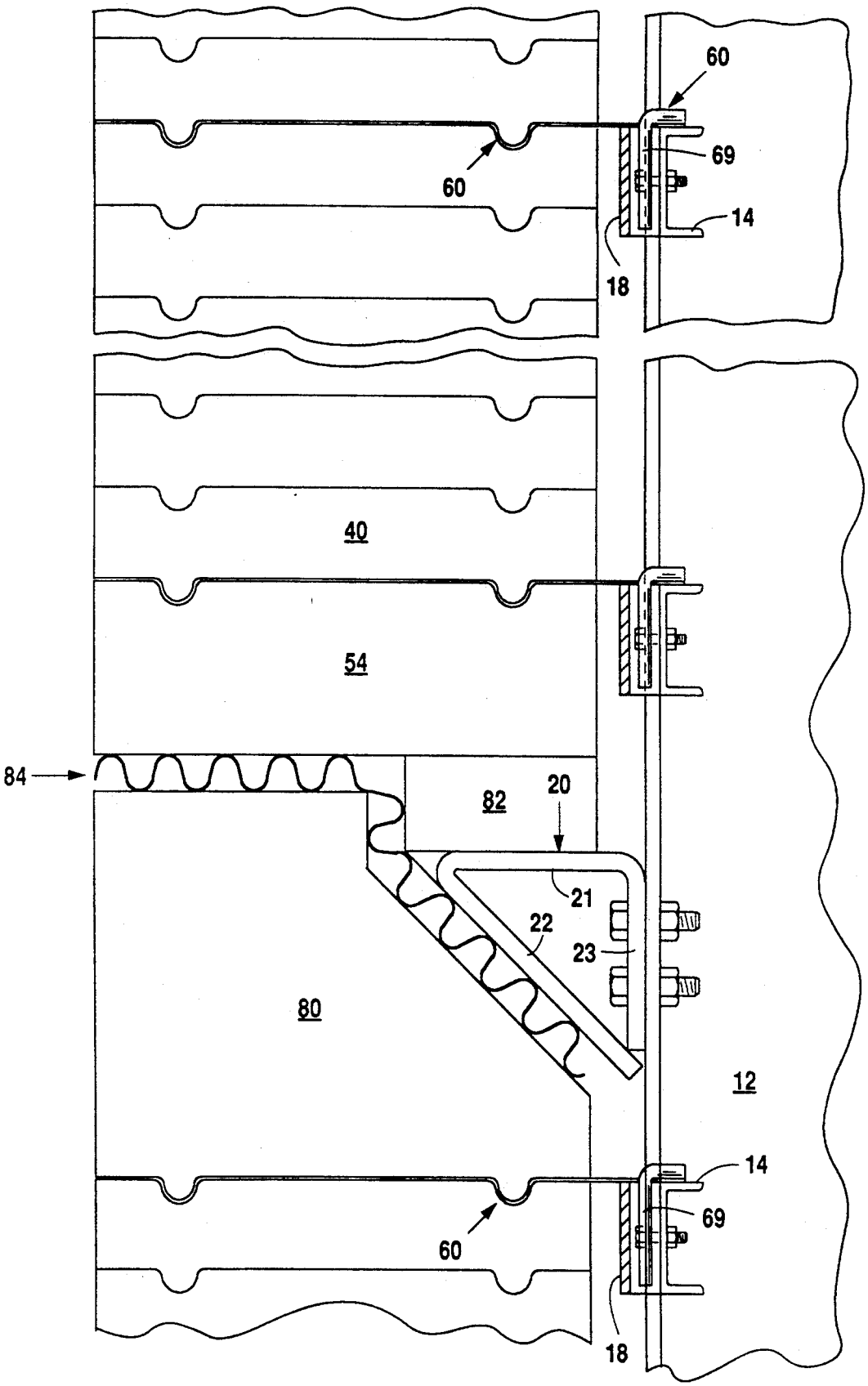
FIG. 12 is a side sectional view showing the positioning of the anchoring members in relation to the wall section and the horizontal members in accordance with the present invention.

The outer support structure 10 may also include a plurality of shelf supports 20 connected to the vertical support members 12 and selectively spaced to provide support for a selected number of sections in the inner refractory wall structure 30. In the preferred embodiment, the shelf supports 20 have a triangular configuration including a top 21, an angular support 22, and a back 23 as best shown in FIG. 12. Between the vertical supports 12, sections of the back 23 may be eliminated to allow movement of air within the shelf supports 20, a feature which is not shown in FIGS. 11 or 12. Alternatively, the back 23 may be perforated to allow for air circulation into the shelf supports 20. In either event, the accommodation of the passage of air to the shelf supports 20 accommodates air cooling of the shelf supports 20, which allows the shelf supports to be fabricated from carbon steel as opposed to cast iron or an alloy. This simplifies installation of the shelf supports 20 and reduces the cost of the structure.

Figure 1:
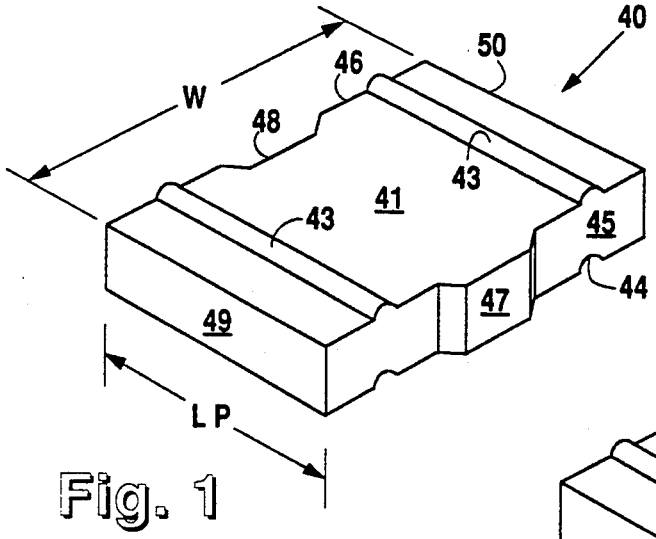
FIG. 1 is an isometric view of a refractory primary brick in accordance with the present invention.

Referring now to FIG. 1, a primary brick 40 of the present invention is shown. The primary brick 40 includes a first surface 41 and a second surface 42, which is typically substantially parallel to the first surface 41. An engaging member 43 is disposed on the first surface 41. The engaging member 43 may have a variety of shapes, so long as the engaging member 43 provides flexibility in the attachment of an anchoring member 60 to the engaging member 43. Similarly, the engaging member 43 may have a variety of positions on the first surface 41 so long as the desired flexibility for anchoring the structure is maintained.

In the preferred embodiment, the primary brick 40 includes a pair of engaging members 43 which are comprised of parallel semi-circular ridges extending from a first end 45 to a second end 46 of the primary brick 40.

Referring still to FIG. 1, the primary brick 40 further has a receiving cavity 44 disposed on the second surface 42. The receiving cavity 44 is adapted to be complementary to the engaging member 43 such that when a first primary brick 40 is placed on another primary brick 40, the engaging member 43 will fit within the receiving cavity 44 to secure the first primary brick to the second primary brick in a manner that substantial precludes relative lateral movement of the bricks.

In the preferred embodiment, the receiving cavity 44 has a semi-circular trough shape slightly larger than, but substantially similar in size and shape to the engaging member 43 on the first surface 41. It will be apparent to those of skill in the art based upon the present disclosure, however, that the shape of the receiving cavity 44 and of the engaging member 43 need not be substantially identical, so long as the two mate to provide a means for receiving an anchoring member 60 (as will be discussed in greater detail below) and to provide the securing of the first primary brick relative to the second primary brick in a manner that substantially precludes lateral movement. For example, the engaging member 43 may be "house" shaped with truncated vertical sides and a triangular top, and the receiving cavities 44 may be substantially rectangular in shape and sized such that the vertically oriented sides of the rectangular groove are slightly larger than the vertical sides of the engaging member. These and other variations in shape will be apparent to those of skill in the art in view of this disclosure.

Referring still to FIG. 1, the first end 45 of the primary brick 40 may further include a second engaging member 47. The second engaging member 47 may have a variety of shapes, so long as such shapes are selected to minimize the possibility of lateral movement of adjacent primary bricks when the bricks are constructed in use. In the preferred embodiment, the engaging member 47 forms a trapezoidal protrusion which is centered on the first side 45 as shown in FIG. 1.

In turn, the second end 46 has a second receiving cavity 48 which is sized, shaped, and positioned to be complementary with the second engaging member 47 of the first end 45 when two primary bricks 40 are placed end to end in use. As shown in FIG. 1, the second receiving cavity 48 of the preferred embodiment has a concave, trapezoidal configuration centered on the second end 46 of the primary brick 40. Like the first engaging member 43 and the first receiving cavity 44, the second receiving cavity 48 and the second engaging member 47 may have a variety of complementary shapes, so long as the interconnection of the second engaging member 47 into the second receiving cavity 48 acts to minimize lateral movement of primary bricks when placed end to end.

One advantage of providing the second engaging member 47 with a trapezoidal configuration is that such a configuration naturally tends to align adjacent bricks in use. That is, the slanted walls of the trapezoidal protrusion of the second engaging member 47 will guide an adjacent brick properly into place, if the bricks are properly made.

A further advantage of providing engaging members on the end faces of bricks such as the engaging member 47 shown in FIG. 1 is that the resulting construction will tend to minimize the passage of gas through the refractory wall when constructed. That is, with the provision of both engaging members 43 and engaging members 47, the possibility for gaseous components of the process being conducted in the furnace escaping directly through the refractory walls is minimized.

Figure 2:
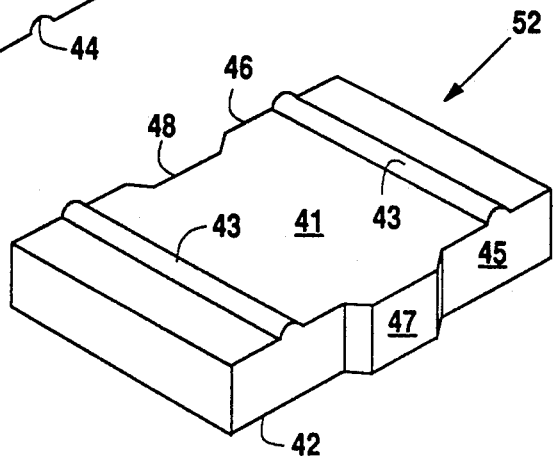
FIG. 2 is an isometric view of a brick similar to the primary brick shown in FIG. 1, but adapted for use as part of a top row or bottom row of bricks in a section of bricks built in accordance with the present invention.

Referring now to FIG. 2, there is shown a modified brick 52 which is adapted for use in the top row or bottom row of a section of the brick wall constructed in accordance with the present invention. As shown in FIG. 2, the modified brick 52 differs from the primary brick 50 only in that the receiving cavities 44 have been eliminated from the second surface 42. In this manner, the second surface 42 provides a flat continuous surface for use in building the top or bottom row of a wall structure. As shown in FIG. 10, in the preferred embodiment, the modified brick 52 will typically be used to build the top row of a section of brick.

Figure 3:
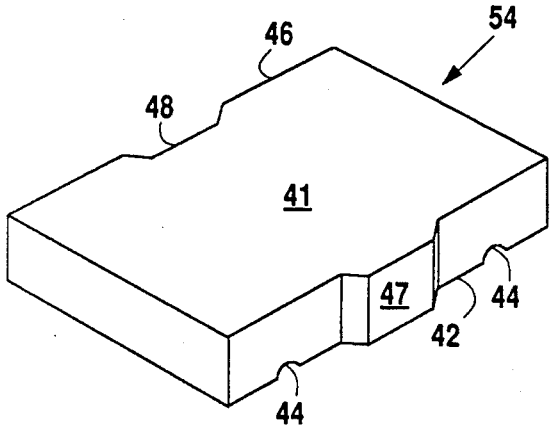
FIG. 3 is an isometric view of a brick similar to the primary brick of FIG. 1, but modified for use in the top row or bottom row of bricks in a section of bricks constructed in accordance with the present invention.

Referring now to FIG. 3, there is shown a second type of modified brick 54, which is again modified for use in constructing the top or bottom row of bricks in a section of bricks. The modified brick 54 differs from the primary brick 40 only in that the engaging members 43 have been eliminated from the first surface 41. In this manner, the modified brick 54 provides a smooth surface for the top or bottom of a section of brick in use.

Figure 4:
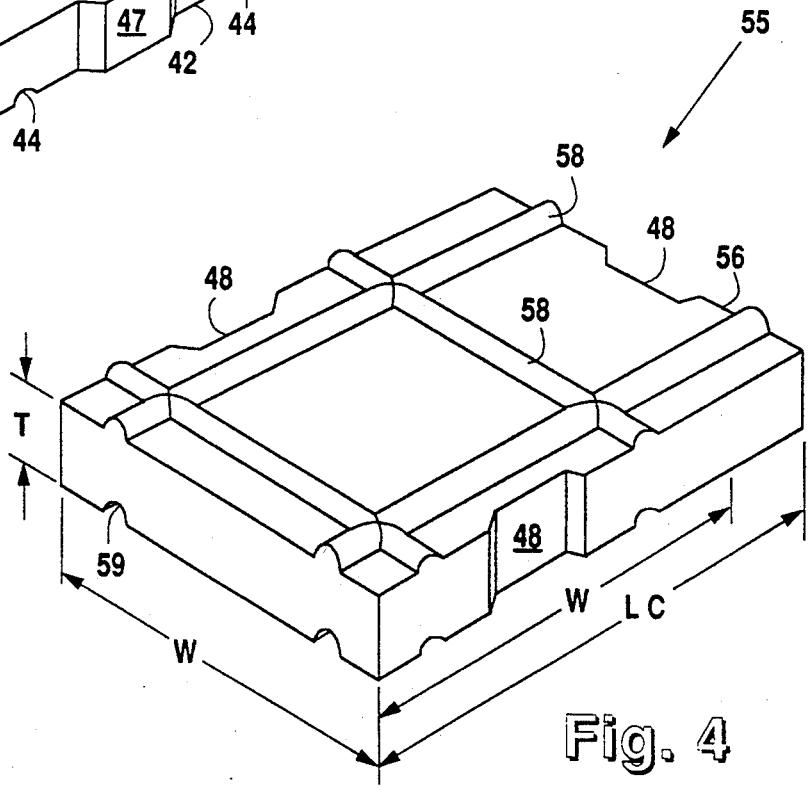
FIG. 4 is an isometric view of a corner brick for use in construction of a wall section in accordance with the present invention.

Referring now to FIG. 4, there is shown a corner brick 55 for use in constructing the corners of rectangular or square furnaces or kilns. In a preferred embodiment, the corner brick 55 is shaped and sized such that when a first corner brick 55 is laid transverse to a second corner brick 55, the corner bricks will cause bricks in successive rows to be offset from each other by a selected portion of the length of a primary brick 40. As shown in FIGS. 1 and 4, the corner brick 55 has the same thickness "T" as a primary brick 40. Similarly, the corner brick 55 has a width W which is substantially identical to the width W of the primary brick 40. The corner brick 55, however, has a length LC which is greater than the length LP of a primary brick 40. The corner brick 55 further has second receiving cavities 48 disposed along each of the sides along its length and in the first end 56 of the corner brick 55 as shown in FIG. 4. The receiving cavity 48 disposed in the first end 56 of the corner brick 55 is positioned to be complementary with a second engaging member 47 of a primary brick 40 such that when the engaging member 47 engages in the receiving cavity 48, the width of the primary brick 40 aligns with the width of the corner brick 55. Similarly, the receiving cavities 48 are disposed on either side along the length of the corner brick 55 such that when a second engaging member 47 of a primary brick 40 is engaged within the receiving cavity 48, a side 49 or 50 of the primary brick 40 will align with the second end 57 of the corner brick 55 in use.

The corner brick 55 further includes a plurality of engaging members 58 and receiving cavities 59 disposed on the opposing upper and lower surfaces of the corner brick 55 to be complementary with the engaging members 43 and receiving cavities 44 of the primary and modified bricks 40, 52 and 54. In the preferred embodiment, the engaging members comprise semi-circular ridges 58 which are essentially identical in shape and size to the engaging members 43 of a primary brick 40. As in the preferred embodiment of the primary brick 40, the engaging members 58 comprise two pairs of parallel ridges which are shaped and positioned to align with the engaging members 43 when primary bricks are placed adjacent to the corner brick 55 in use. Accordingly, the engaging members 58 form a cross-hatch, tic-tac-toe configuration such as is shown in FIG. 4. Similarly, the receiving cavities 59 have a semi-circular concave configuration which is slightly larger than, and complementary in size and shape to the engaging members 58. In the preferred embodiment, the receiving cavities 59 also form a cross-hatch, tic-tac-toe configuration complementary to the engaging members 58 shown in FIG. 4.

Figure 5:
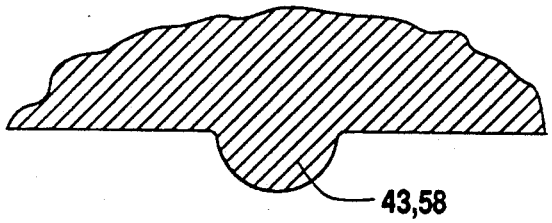
FIG. 5 is a cross sectional detail of an engagement member of any of the bricks shown in FIGS. 1, 2 or 4 of the present invention.
Figure 6:
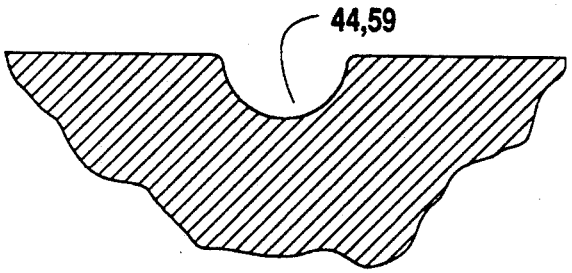
FIG. 6 is a cross sectional view showing the receiving cavity disposed on the first or second surfaces of any of the bricks shown in FIGS. 1, 3 or 4 of the present invention.
Figure 7:
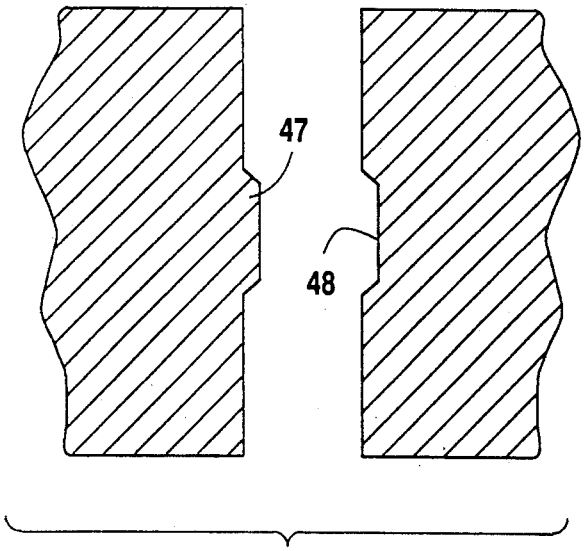
FIG. 7 is a cross sectional view illustrating the end engagement members and end receiving cavities for any of the bricks shown in FIGS. 1, 2, 3 or 4.

Referring now to FIGS. 5 and 6, there is shown in section the preferred embodiment of the engaging members 43 (or 58) and the receiving cavities 44 (or 59) of the present invention. As shown in FIGS. 5 and 6, the engaging members 43 (or 58) comprise a semi-circular ridge formed integrally with the particular brick to which it is attached. In turn, the receiving cavity 44 (or 59) forms a semi-circular groove which has a radius slightly larger than the radius of the engaging member 43 such that an anchoring member 60 may fit between the engaging member 43 and the receiving cavity 44 in use. It is believed that the utilization of a semi-circular ridge accommodates the centering of the bricks relative to each other and helps minimize the lateral movement of the bricks relative to each other FIG. 7 illustrates the trapezoidal shape of the second engaging members 47 of the various bricks and the complementary trapezoidal shape of the receiving cavities 48 of such bricks. As stated above, the slanted walls provided by the trapezoidal configuration assist in aligning adjacent bricks relative to each other.

Figure 8:
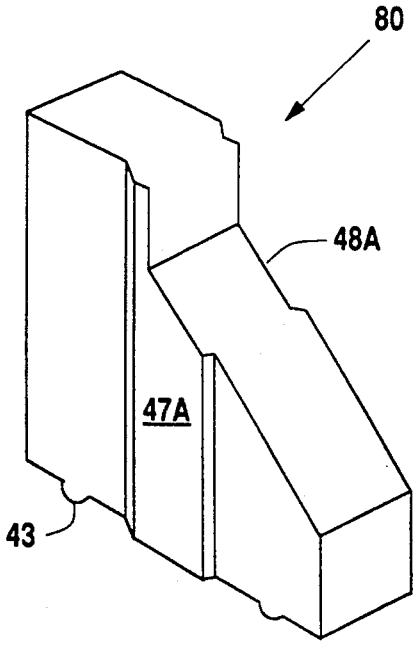
FIG. 8 is an isometric view of a "shelf division" brick constructed in accordance with the present invention.

Referring now to FIG. 8, there is shown a section. divisional brick 80. As will be explained in greater detail below, the sectional divisional brick 80 is a specially shaped brick designed to assist in the construction of sections within a refractory wall system 30. In the preferred embodiment, the divisional brick 80 is shaped to be complementary with the configuration of the shelf support 20 and with the underlying brick upon which it will be placed in use. For example, in the preferred embodiment, the divisional brick 80 includes engaging members 43 disposed on the surface of the divisional brick 80 which will reside on top of a surface of a primary brick 40 having receiving cavities 44. In this manner, the divisional brick 80 will be lodged on top of the primary brick 40 in a manner which will minimize the possibility for movement of the divisional brick 80 relative to the primary bricks 40 in use.

Similarly, the divisional brick 80 may include a second engaging member 47A and a second receiving cavity 48A each of which is similar in shape and nature to the engaging member 47 and receiving cavities 48 of the primary brick 40. Adjacent division bricks 80 are thereby interconnected to each other in a manner similar to the interconnection of the primary bricks to each other.

Figure 9:
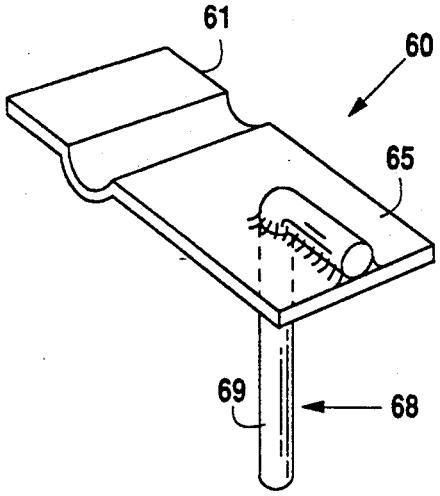
FIG. 9 is an isometric view of an anchoring member constructed in accordance with the present invention.

Referring now to FIG. 9, there is shown an anchoring member 60 of the present invention. The anchoring member comprises an attachment section 61, an extension section 65 and a connecting pin 68. The attachment section 61 is adapted to fit over an engaging member 43 and within a receiving cavity 44 to secure the anchoring member 60 to adjacent bricks in use. In the preferred embodiment the attachment section 61 has an arcuate configuration complementary in size and shape to the engaging members 43 and receiving cavities 44 of the preferred embodiment. That is, the radius of curvature of the attachment section 61 is slightly greater than the radius of the engaging member 43 and slightly less than the receiving cavity 44 such that the attachment member 61 nests over the engaging member 43 and within the receiving cavity 44 in use.

An extension section 65 is attached to the attachment section 61 and extends from the attachment 61 for a selected distance outside of the bricks in use. The extension section 65 may take a variety of shapes and sizes adapted to provide minimal separation of adjacent bricks 40 into which it is asserted and, at the same time, provide the desired strength of attachment between the connecting pin 68 and the attachment section 61. In the preferred embodiment, the extension section 65 has a flat, rectangular configuration which extends past the outer edge of the bricks to the vertical supports when installed in use as shown in FIGS. 10, 11, and 12.

A connecting pin 68 is attached to the extension member 65 and extends downwardly for engagement into an aperture 16 of the outer support system 10. In the preferred embodiment, the connecting pin member 68 comprises an L-shaped bar which is welded to the extension section 65 such that the connecting pin member 68 provides a vertically oriented pin 69 which is adapted for engagement in the aperture 16 in use. It will be apparent to those of skill in the art in light of the present disclosure, however, that the L-member 68 need not be L-shaped. Rather, the member 68 need only provide an appropriately oriented pin 69 which is adapted to interact with the receiving members 16 in the outer shelf in a manner which allows for vertical movement of the pin 69 relative to the receiving aperture 16. That is, the interaction of the pin 69 with the receiving member or aperture 16 must be such that vertical movement of the pin 69 is permitted in response to vertical expansion due to heat of the refractory brick section 30, while at the same time precluding or minimizing relative lateral movement of the brick section 30.

An important feature of the anchoring member 60 is that the attachment section 61 is provided with a configuration that is not only complementary with the engaging member 43 and the receiving cavity 44, but which is complementary to the engaging member 43 and receiving cavity 44 in a manner that allows the positioning of the anchoring member 60 at any point along the engaging member 43. In this manner, flexibility is provided with regard to the positioning of the anchoring member 60. This greatly simplifies the tying of the anchoring members 60 to the vertical and horizontal supports and the resulting construction of the refractory furnace of the present invention.

Accordingly, referring again to FIGS. 10 and 12, when a furnace of the present invention is constructed, a plurality of vertical supports 12 and horizontal supports 14 are constructed having a spacing and configuration adapted for the desired rigidity and strength, and adapted to space the horizontal supports to coincide with an interface of successive layers of bricks. Sleeve-forming members are then selectively attached to the vertical supports 12 and horizontal supports 14 to provide the desired spacing for attachment of anchors 60. A plurality of modified bricks 54 are placed on the floor inside the skeleton built of vertical supports 12 and horizontal supports 14. In the preferred embodiment, the bricks are oriented so that the cold "faces" of the bricks are approximately one inch from the innerface of the I-beams of the vertical support 12. Successive rows of primary bricks 40 are built on top of the modified bricks 54 until a desired height for a first section of brick is obtained. A row of section divisional brick 80 is then installed on top of the primary bricks 40 as shown in FIG. 10. An insulation/expansion material layer 84 such as is known to those of ordinary skill in the art is installed on top of the division brick 80. A first shelf support 20 is then attached to the vertical support 12 and positioned on top of the insulation layer 84. A filler brick 82 is positioned on top of the shelf support 84 such that the top of the filler brick 82 and the top of the insulation layer 84 form a substantially continuous level surface. This process is repeated for successive sections of brick until the desired height of the furnace or kiln is reached. In the preferred embodiment, the top row of bricks will be comprised of the modified bricks 52 (or 54 if the modified brick 52 is used as the base layer) such that the top surface of the inner refractory brick wall will be level and smooth.

It will be appreciated by those of skill in the art that expansion joints (not shown) may also be selectively provided to account for horizontal expansion of the bricks. In the preferred embodiment, the expansion joint insulation blankets are placed between adjacent ends of the bricks (e.g. brick 40). In this regard, the bricks of the present invention enhance use of such expansion joints because the engaging member 47 and receiving cavity 48 will hold the insulation blanket in place between the bricks.

The instant invention has been disclosed in connection with the specific embodiment. However, it will be apparent to those skilled in the art that the variations from the illustrated embodiment may be undertaking without departing from the spirit and scope of the invention. For example, the shape of the engaging members 43 may be varied in a number of ways. This and other variations will be apparent to those skilled in the art in view of the above disclosure and are within the spirit and scope of the invention.

As used in this specification and in the appended claims, it should be understood that the word "connect" or any derivative thereof, implies not only a direct, immediate connection between the two recited parts, but also embraces the various arrangements when the parts are operatively connected, although other elements may be physically located or eliminated between the connected parts. Further, the word "a" does not preclude the presence of a plurality of elements accomplishing the same function. For example, "a receiving cavity" should be understood to include either a single receiving cavity or a pair of receiving cavities carrying out the same function.

What is claimed is:

1. An improved wall construction system for refractory furnaces, comprising:

(a) an outer support structure having a vertically disposed aperture;

(b) a first refractory brick having a first surface and a second surface substantially parallel to the first surface, the first refractory brick further including a first engaging member disposed on the first surface;

(c) a second refractory brick having a first surface and a second surface substantially parallel to the first surface, the second refractory brick having a first receiving cavity shaped complementary to the first engaging member and positioned on the second surface of the second refractory brick such that the first engaging member of the first refractory brick engages within the first receiving cavity of the second refractory brick when the second refractory brick is placed upon the first refractory brick in use; and (d) an anchoring member comprising an attachment section, an extension section and a connecting pin, the attachment section being shaped and sized complementary to the first engaging member and the first receiving cavity such that the attachment section is adapted to fit over the first engaging member and within the first receiving cavity in use to secure the attachment section between the first and second refractory bricks, the extension section being secured to the attachment section and shaped and adapted to fit between the first surface of the first refractory brick and the second surface of the second refractory brick and extend a selected distance outwardly from the first and second refractory bricks when installed in use and the connecting pin being secured to the extension section and positioned and sized such that connecting pin is adapted to fit movably in the aperture in the support structure to allow movement of the connecting pin within the aperture upon vertical expansion and resulting movement of the first and second refractory bricks.

2. The wall construction system of claim 1 wherein (i) the first engaging member has a substantially semi-cylindrical shape of a selected radius in cross-section, the first engaging member extending from a first end of the first refractory brick to a second end of the first refractory brick; (ii) the first receiving cavity has a semi-cylindrical shape having a slightly greater radius in cross section than the radius of the first engaging member, the first receiving cavity extending from a first end of the second refractory brick to a second end of the second refractory brick; and (iii) the attachment section of the anchoring member has an arcuate configuration complementary to the first engaging member and the first receiving cavity such that the anchoring member may be selectively positioned along the length of the first engaging member in use.

3. An improved wall construction system for refractory furnaces, comprising:

(a) an outer support structure having a vertically disposed aperture in use;

(b) a first refractory brick comprising a first surface and a first end, the first refractory brick further including a first engaging member disposed on the first surface and a second engaging member disposed on the first end;

(c) a second refractory brick comprising a second surface and a first end, the second refractory brick having a first receiving cavity shaped complementary to the first engaging member of the first refractory brick and positioned on the second surface of the second refractory brick such that the first engaging member of the first refractory brick engages within the first receiving cavity of the second refractory brick when the second refractory brick is placed upon the first refractory brick, the second refractory brick further having a third engaging member disposed o the first end of the second refractory brick;

(d) a third refractory brick comprising a first surface and a first end, the third refractory brick including a fourth engaging member disposed on the third refractory brick first surface and further having a second receiving cavity positioned in its first end, the second receiving cavity being shaped to be complementary with the second engaging member of the first refractory brick such that the second engaging member engages within the second receiving cavity of the third refractory brick when the first end of the third refractory brick is placed adjacent to the first end of the first refractory brick in us in order to restrain lateral movement of the third refractory brick relative to the first refractory brick;

(e) a fourth refractory brick comprising a second surface and a first end, the fourth refractory brick having a third receiving cavity in its second surface and a fourth receiving cavity in its first end, the third receiving cavity and fourth receiving cavity being positioned and shaped such that when the fourth refractory brick is placed upon the third refractory brick with the first end of the fourth refractory brick adjacent to the first end of second refractory brick, the third engaging member engages within the third receiving cavity and the fourth engaging member engages within the fourth receiving cavity to restrain lateral movement of the fourth refractory brick relative to the second and third refractory bricks; and (f) an anchoring member comprising an attachment section, an extension section and an section, the attachment section and the extension section being shaped and sized complementary to the first engaging member, the first receiving cavity, the first surfaces of the first and third refractory bricks and the second surfaces of the second and fourth refractory bricks such that the attachment section fits over either the first engaging member of the first refractory brick or the fourth engaging member of the third refractory brick and within either the first receiving cavity of the second refractory brick or the third receiving cavity of the fourth refractory brick in use to secure the attachment section between a row of first and third refractory bricks and a row of second and fourth refractory bricks, the extension member being secured to the attachment section, and adapted to extend between the first surfaces of the first and third refractory bricks and the second surfaces of the second and fourth refractory bricks, and to further extend a selected distance from the refractory bricks, the connecting pin being secured to the extension section and positioned and sized such that the connecting member is adapted to fit movably in the aperture in the support structure to allow movement of the connecting member within the aperture upon vertical expansion and resulting movement of the first and second refractory bricks in use.

4. The wall construction system of claim 3 wherein: (i) each of the first and fourth engaging members has a substantially semi-cylindrical shape having a selected radius in cross section, the first engaging member extending from the first end of the first refractory brick to a second end of the first refractory brick and the third engaging member extending from the first end of the third refractory brick to a second end of the third refractory brick, the first and fourth engaging members further being substantially aligned at the first end of the first and third refractory bricks when installed in use; (ii) each of the first and fourth receiving cavities has a substantially semi-cylindrical shape having a slightly greater radius in cross-section than the radius of the first and fourth engaging members, the first and fourth receiving cavities further being substantially aligned at the first end of the second refractory brick and at the first end of the fourth refractory brick when installed in use; and (iii) the attachment section of the anchoring member has an arcuate configuration complementary to the first engaging member and the first receiving cavity such that the anchoring member may be selectively positioned along the length of the first or fourth engaging members in use.

5. An improved wall construction for refractory furnaces, comprising:

(a) an outer support structure including a plurality of vertical support members and a plurality of horizontal support members connected to the vertical support members, the horizontal support members having a plurality of vertically disposed apertures;

(b) a plurality of regularly-shaped bricks, the bricks each having a first surface, a second surface substantially parallel to the first surface, a first end and a second end, each first surface including a first engaging member extending from the first end to the second end; each second surface having a first receiving cavity extending from the first end to the second end; wherein the first engaging member and the first receiving cavity are complementarily shaped and positioned such that the first engaging member on a first brick will engage with the first receiving cavity of a second brick to restrain lateral movement of such a second brick relative to such a first brick when such a second brick is stacked on such a first brick; the first end having a second engaging member and the second end having a second receiving cavity, wherein the second engaging member and the second receiving cavity are shaped and positioned to be complementary with each other such that when a first brick is positioned with its first end adjacent the second end of a second brick, the second engaging member of such a first brick will engage in the second receiving cavity of such a second brick to restrain lateral movement of such a second brick relative to such a first brick; the positioning and shaping of the first and second engaging members and the first and second receiving cavities further being coordinated such that when the first end of a first brick is placed adjacent the second end of a second brick, the second engaging member of such a first brick is aligned within the second receiving cavity of such a second brick and the first engaging member of such a first brick aligns with the first engaging member of such a second brick; and (c) a plurality of anchoring members each comprising an attachment section, an extension section and a connecting pin, the attachment section being shaped and sized complementary to the first engaging member and the first receiving cavity of a brick such that the attachment section fits over the first engaging member and within the first receiving cavity in use when a first brick is stacked on a second brick to secure the attachment section between such first and second bricks; the extension section being secured to the attachment section, and adapted to extend between the first surface of such a first brick and the second surface of such a second brick, the extension member further extending a selected distance from such first and second refractory bricks in use; and the connecting pin being secured to the extension section and positioned and sized such that connecting pin fits movably in an aperture in a horizontal support in use to allow movement of the connecting pin within the aperture upon vertical expansion and resulting movement of the first and second refractory bricks.

* * * * *

UNITED STATES PATENT AND TRADEMARK OFFICE

CERTIFICATE OF CORRECTION

PATENT NO. : 5,277,580
DATED : January 11, 1994
INVENTOR(S) : John Miskolczi, Jr.

It is certified that error appears in the above-indentified patent and that said Letters Patent is hereby corrected as shown below:

In claim 3 at column 12, line 5, delete "o" and insert --on--.

In claim 3 at column 12, line 19, delete "us" and insert --use--.

In claim 3 at column 12, line 38, delete "an section" and insert --a connecting pin--.

In claim 3 at column 12, line 60, delete "member" and insert --pin--.

In claim 3 at column 12, line 63, delete "member" and insert --pin--.

Signed and Sealed this

Nineteenth Day of July, 1994

*Attest:*

*Attesting Officer*

Bruce Lehman

BRUCE LEHMAN

*Commissioner of Patents and Trademarks*